US005964069A

United States Patent [19]

Schmidt

[11] Patent Number: 5,964,069

[45] Date of Patent: Oct. 12, 1999

[54] BRIDGING MEANS FOR JOINT GAP

[75] Inventor: Erich Schmidt, Unterfoehring, Germany

[73] Assignee: Maurer Soehne GmbH & Co. KG, Munich, Germany

[21] Appl. No.: 08/879,073

[22] Filed: Jun. 19, 1997

[30] Foreign Application Priority Data

Jul. 26, 1996 [DE] Germany ..... 196 30 328

[51] Int. Cl.[6] ..... E04B 1/68; E04B 1/686

[52] U.S. Cl. ..... 52/396.05; 52/393; 52/402; 52/573.1; 404/47; 404/56; 404/68

[58] Field of Search ..... 52/393, 396.04–396.06, 52/396.08, 402, 573.1; 404/56, 68, 69, 47

[56] References Cited

U.S. PATENT DOCUMENTS

| | | | |
|---|---|---|---|
| 1,992,756 | 2/1935 | Masterson . | |
| 3,698,292 | 10/1972 | Koester | 94/18 |
| 3,797,952 | 3/1974 | Pommerening et al. | 404/52 |
| 3,854,159 | 12/1974 | McLean et al. | 14/16 |
| 3,880,540 | 4/1975 | Rizza et al. | 404/69 |
| 3,904,302 | 9/1975 | Bertschmann | 404/68 |
| 4,050,207 | 9/1977 | Bertschmann et al. | 52/396 |
| 4,075,728 | 2/1978 | Puccio | 14/16.5 |
| 4,076,440 | 2/1978 | Bertschmann | 404/69 |
| 4,111,584 | 9/1978 | Fyfe | 404/69 |
| 4,339,214 | 7/1982 | Puccio et al. | 404/69 |
| 4,773,791 | 9/1988 | Hartkorn | 404/68 |
| 5,887,308 | 3/1999 | Walter | 14/73.1 |

FOREIGN PATENT DOCUMENTS

| | | |
|---|---|---|
| 4138347 | 5/1993 | Germany . |
| 4303268 | 8/1994 | Germany . |
| 4433909 | 4/1996 | Germany . |

*Primary Examiner*—Christopher T. Kent
*Assistant Examiner*—Yvonne Horton-Richardson
*Attorney, Agent, or Firm*—Jordan and Hamburg LLP

[57] ABSTRACT

A bridging means for joint gaps between building components with an expansion joint construction bridging the joint gap, which is mountable on both sides of the joint gap on the building parts, is characterized in that at least between one of said building components and the expansion joint construction a safety means is arranged which is of such construction that said expansion joint construction will be guided out of the joint gap, if a limiting force acting between said building components is exceeded. Said safety means preferably is formed as slide ramp means between said expansion joint construction and the building component.

14 Claims, 6 Drawing Sheets

BRIDGING MEANS FOR JOINT GAP

BACKGROUND OF THE INVENTION

Figure 1A:
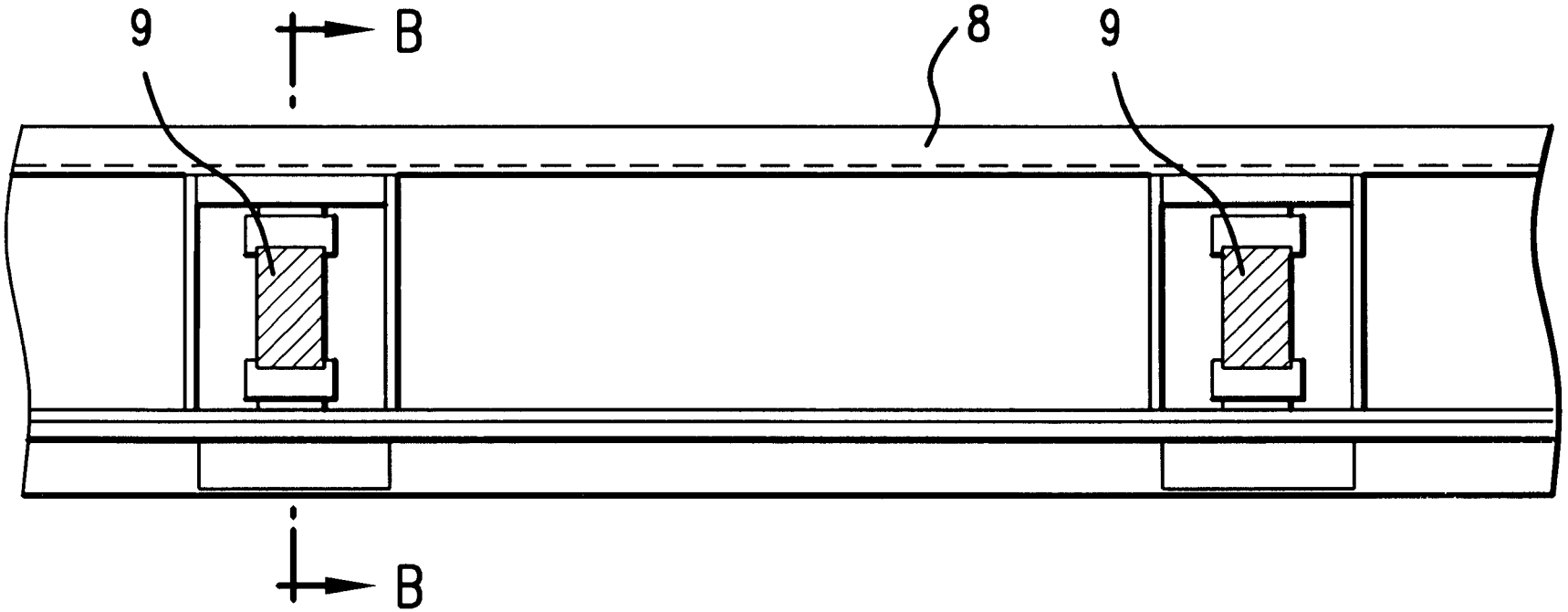

The present invention pertains to a bridging means for joint gaps between building components with an expansion joint construction bridging said joint gap, which can be fixed on both sides of the joint gap on the building components.

For bridging joint gaps and/or expansion joints, respectively, between two building components—between a bridge and their support or abutment e.g.—various solutions are known. In everyday practice these solutions have proved successful. However, there exists the problem that the possibly quite large-scale and expensive expansion joint constructions and the bordering building components, like bridge corpuses and abutments, may be destroyed in exceptional situations, in case of an earthquake e.g.

SUMMARY OF THE INVENTION

The present invention is directed to overcoming this problem.

The present invention achieves this aim by the subject matter of patent claim 1. As compared to the generic prior art, the present invention is distinguished in that at least between one of the building components and the expansion joint construction a safety means is arranged which is of such construction that said expansion joint construction will be guided out of the joint gap, will slide out e.g., if a limiting force acting on said expansion joint construction (i.e. in case of movements of the building components with respect to one another) is exceeded.

The present invention starts at the point of recognition of necessity for a protection against destruction by exorbitant forces as may be caused by ground movements e.g. during an earthquake and realizes such protection by a "separate" member which in everyday use is fixedly disposed between expansion joint construction and building component that said expansion joint construction safely remains in the joint gap in everyday operation. However, in case of a limiting force being exceeded, it is secured against destruction with the bordering building components. After the earthquake having ended, the construction will return into its initial position and thus permits being passed by emergency vehicles.

A particularly preferred embodiment of the present invention is distinguished in that said safety means is built as slide ramp means disposed between insert component and building component. A slide ramp is a constructionally particularly simple possibility of realizing an efficient earthquake protection which, however, in efficient manner guides the expansion joint construction out of the joint gap in case of excessively big movements of the building components with respect to one another (e.g. >250 mm). It is guaranteed by means of welding seams or another kind of connection which can at least approximately be defined with respect to strength, between the slide ramp components that the joint will only slide out of the gap in case of a given limiting condition being exceeded—i.e. in an exceptional situation like an earthquake.

In accordance with a further particularly preferred embodiment of the present invention the safety means is built as safety box insertable between the bridging expansion joint construction and the building component.

Further preferred embodiments of the present invention are stated in the remaining subclaims.

In the following a preferred embodiment of the present invention is described in more detail with reference to the drawing, wherein further advantages and effects will become obvious.

LIST OF FIGURES

Figure 1B:
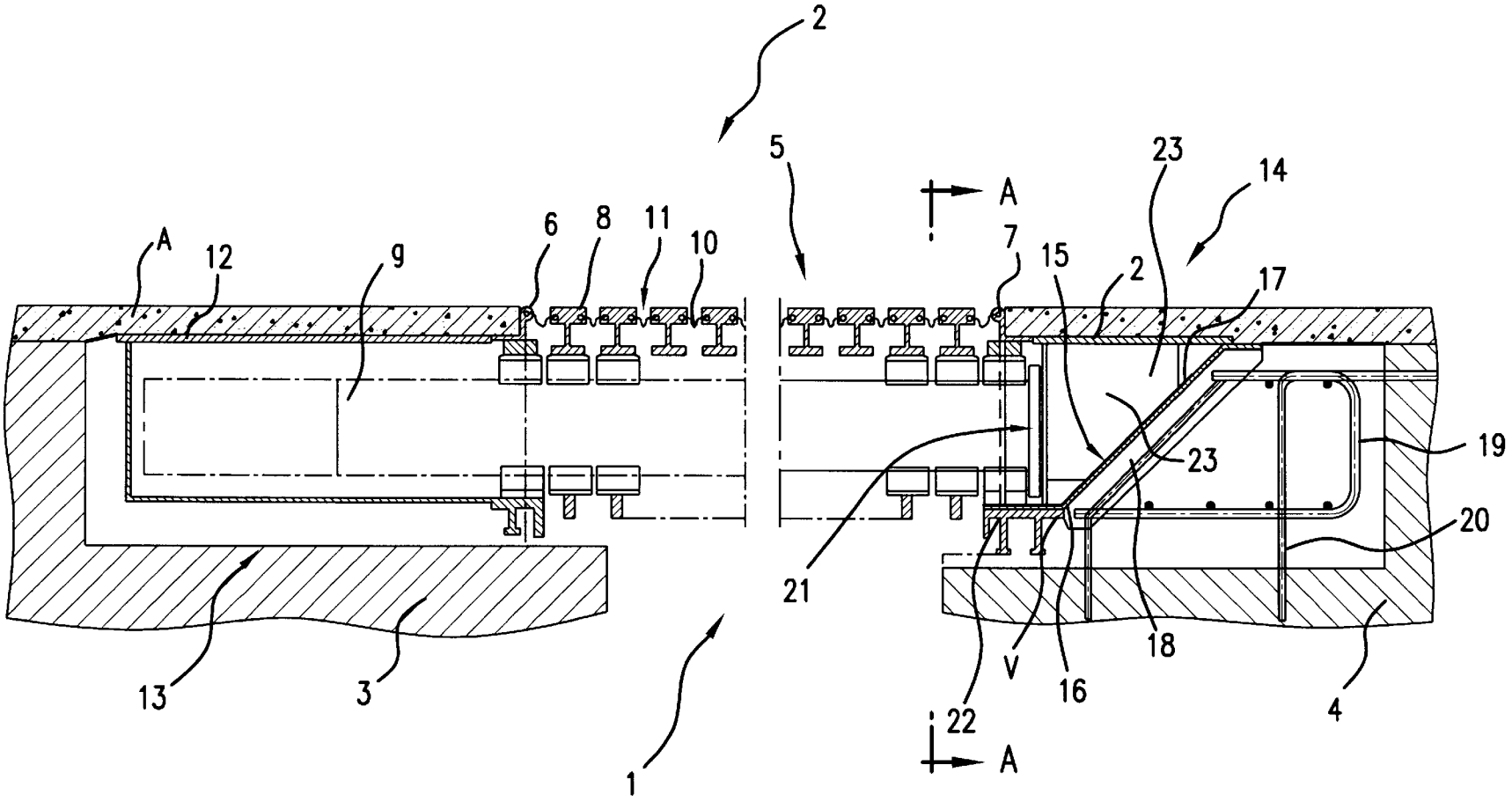

FIGS. 1A to 1B show various sectional views of a first embodiment of the present invention (sections A—A; B—B).

Figure 2A:
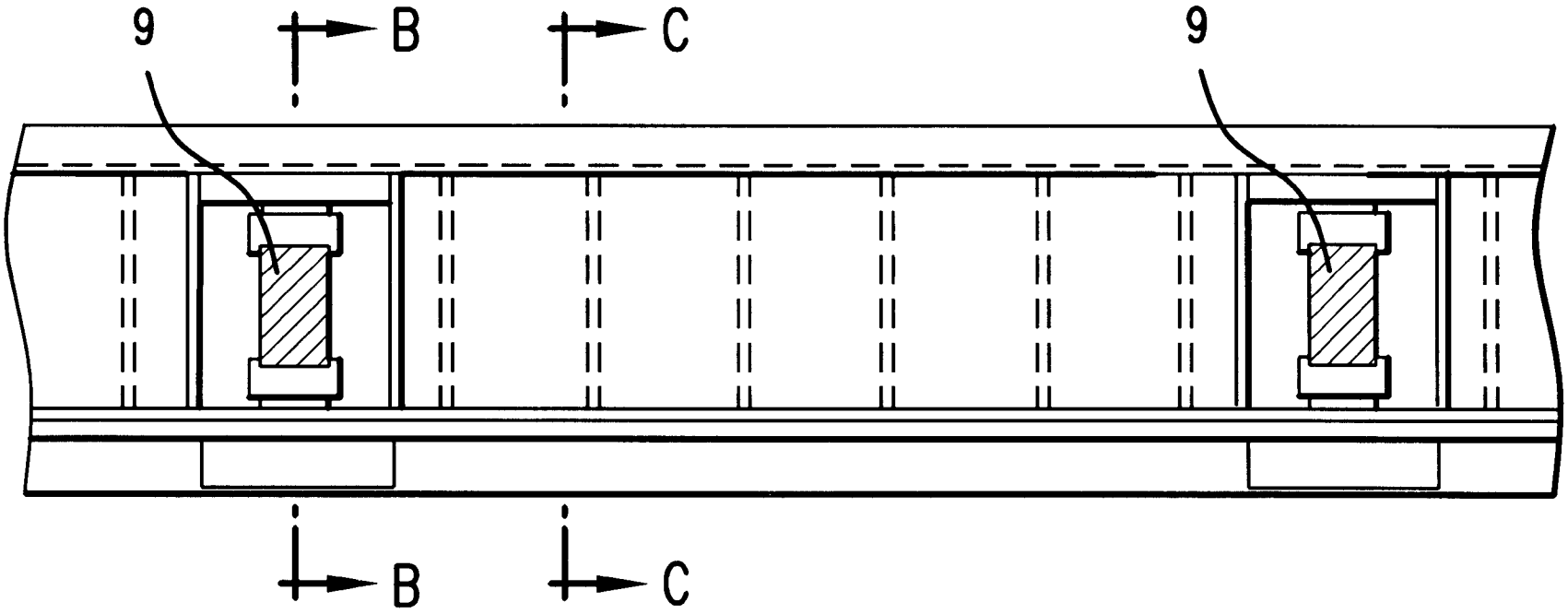
Figure 2B:
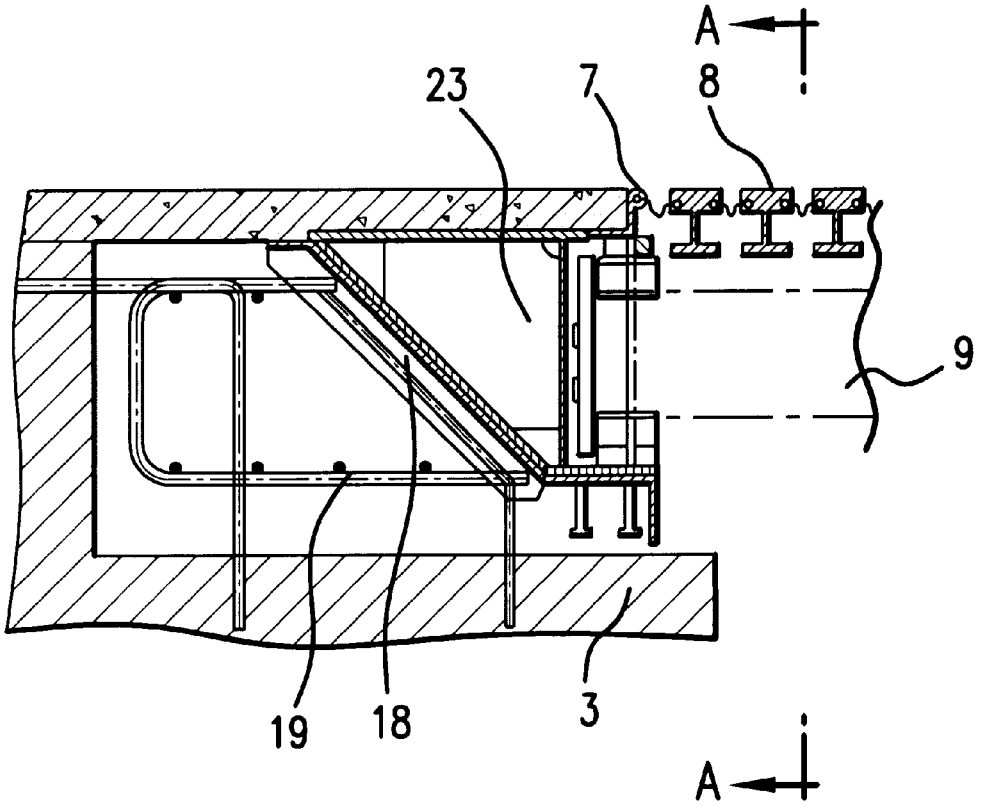
Figure 2C:
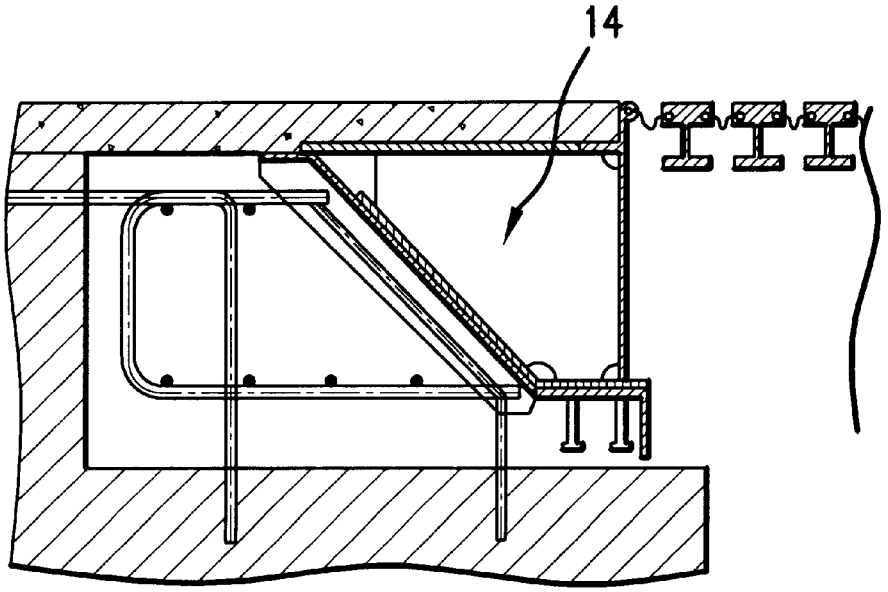

FIGS. 2A to 2C show various sectional views of a second embodiment of the present invention (sections A—A; B—B; C—C).

Figure 3A:
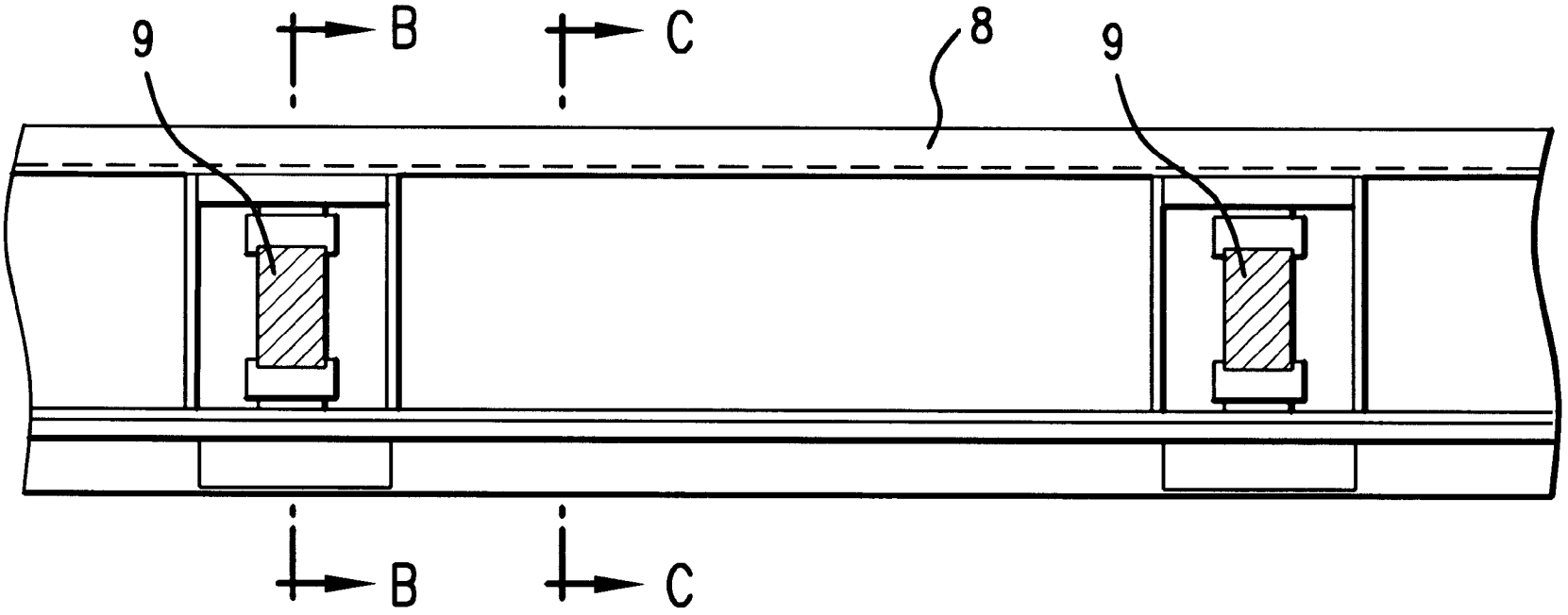
Figure 3B:
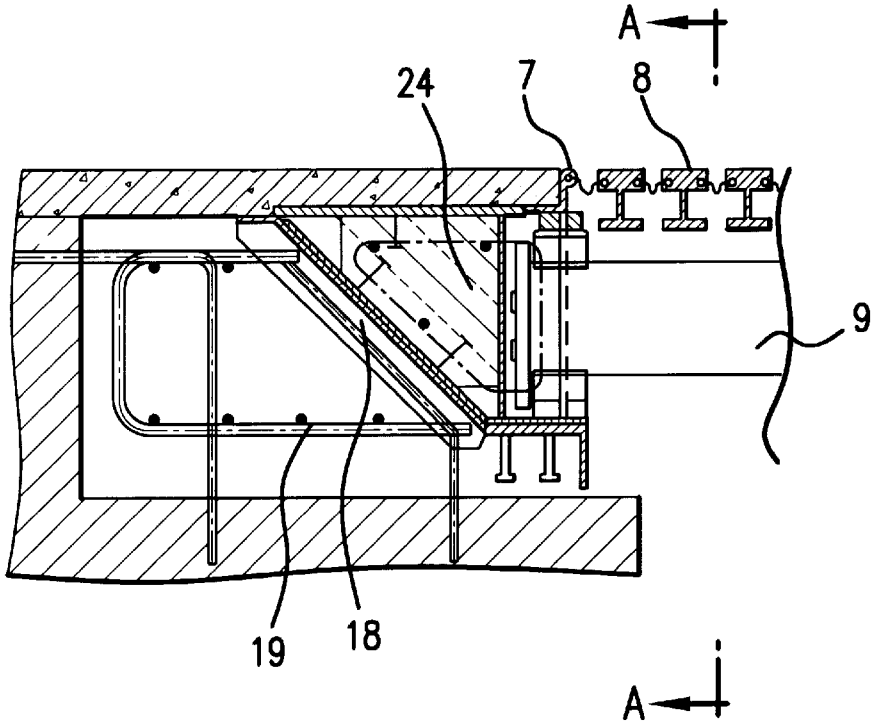
Figure 3C:
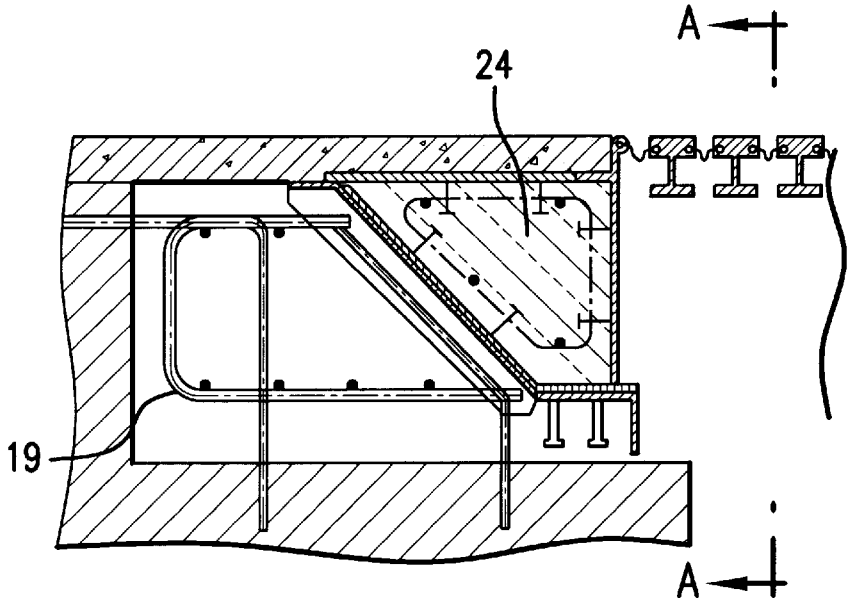

FIGS. 3A to 3C show various sectional views of a third embodiment of the present invention (sections A—A; B—B; C—C).

DETAILED ACCOUNT OF WORKING EXAMPLE OF THE INVENTION

First of all FIG. 1 will be described. FIG. 1B shows a first embodiment of the present invention in a sectional view in vertical direction to the joint gap 1. FIG. 1A shows a section in a plane lying in the gap.

A bridging means 2 for the joint gap 1 between building components 3, 4 comprises an expansion joint construction 5 bridging said joint gap 1, which is fixed on both sides of said joint gap 1 on the building components 3, 4. Said expansion joint construction 5 includes marginal profiles 6, 7 anchored on the rims of the respective building components and central profiles 8 extending in parallel to said marginal profiles. Said central profiles 8 are disposed on tie-bars bridging said joint gap 1. Expansion strips 10 made from elastic material bridge the remaining small gaps 11 between said marginal and/or central profiles 6, 7, 8, respectively, so that minor expansions—generally caused by thermal changes—of said building components 3, 4 are compensated. In the left-hand side of FIG. 1B said tie-bar 9 is supported in a tie-bar box 12 made from steel, said tie-bar box 12 again being arranged on bottom of a recess 13 of said building component 3. A cover A—made from concrete polymer e.g.—into which said marginal profiles 6, 7 are cast is mounted above said tie-bar box 12.

Between one of said building components—here: a bridge component 4—and the expansion joint construction 5 a safety means 14 is arranged which is formed such that said expansion joint construction 5 slides out of the joint gap 1 in case of a limit force acting on said expansion joint construction being exceeded. In the present embodiment, said safety means 15 comprises a second slide ramp 15 located between said expansion joint construction 5 and said bridge component 4, with a building-side inclined steel plane 16 as well as a further inclined steel plane 17 adapted to said inclined plane 16 of said building component 4, which further plane forms part of a steel frame construction S of said safety means 14. Said safety means here is realized as kind of prefinished "box" which is exchangeable arbitrarily. The two inclined planes 16, 17 one disposed on top of the other in cooperation form the slide ramp 15.

The building-side inclined steel plane 16 is arranged on a concrete anchoring disk 18 being anchored in the building by means of an anchoring stirrup piece 19 and further anchoring parts. Anchoring of said expansion joint construction 5, said safety means 14 and said anchoring disk 18 on said building parts is additionally effected by concrete polymer e.g.

Said tie-bars 9 engage with correspondingly formed shafts 21 of said safety boxes 14, where they lie between marginal profiles 6, 7 and the bottom of said shaft 21 by means of spacer elements 22.

The embodiments of FIGS. 2 and 3 essentially differ only in that on one hand a steel body 23 (FIG. 2) and on the other hand a concrete body 24 (FIG. 3) are introduced in said steel frame S of said safety box 14 for giving stability to said safety box 14.

Whereas in accordance with FIGS. 1 to 3 safety boxes (FUSE-BOX) 14 are provided for only on one side respectively of said joint gap 1, it is of course also possible to arrange those on both sides of said joint gap 1.

As to functioning of the invention it is to be noted that during an earthquake the weld V between the planes 16 and 17 will tear up due to the movements of the building components with respect to one another so that said expansion joint construction 6 can slide out of said joint gap. It is true that in the example of FIGS. 1 to 3 the roadway paving will be torn up, but within the frame of earthquake damages this, however, is a negligible economy-priced damage which can be repaired easily. The important point is that the expansion joint construction 5 and the bordering building component 3, 4 are left (more) undamaged so that after the earthquake still only the safety box 15 has to be fastened again or to be welded again (the box 14 is easily accessible from top and bottom through the gap). Damages caused by earthquakes thus generally can be overcome in simple manner quickly and at low price.

Of course it also is conceivable to choose another exchangeable kind of connection, e.g. a nut/pin or rivet construction or the like, in which only the connecting members had to be exchanged after the damage event, instead of the welding construction.

LIST OF REFERENCE NUMERALS

1 joint gap
2 bridging means
3, 4 building components
5 expansion joint construction
6,7 marginal profiles
8 central profiles
9 tie-bars
10 expansion strips
11 gap
12 tie-bar box
13 recess 27
14 safety means or box, respectively
15 slide ramp
16, 17 inclined planes
18 anchoring disk
19 anchoring stirrup piece
20 anchoring members
21 shafts
22 spacer elements
23 steel body
24 concrete body
S steel frame
V weld
A cover

What is claimed:

1. A bridging means for joint gaps between building components, with an expansion joint construction bridging said joint gap, which is fixable on both sides of said joint gap on the building components, WHEREIN a safety means is disposed at least between one of said building components and said expansion joint construction, said safety means being constructed such that said expansion joint construction is guided out of said joint gap when a limit force acting between said building components is exceeded.

2. A bridging means for joint gaps as defined in claim 1, WHEREIN said safety means is built as slide ramp located between said expansion joint construction and said building component.

3. A bridging means for joint gaps as defined in claim 1 or 2, WHEREIN said safety means is built as safety box incorporable between said expansion joint construction and said building component.

4. A bridging means for joint gaps as defined in claim 3, WHEREIN said safety box comprises a steel frame which is connected, welded in particular, to said building component.

5. A bridging means for joint gaps as defined in claim 3, WHEREIN said safety box is filled with concrete, steel or plastic material.

6. A bridging means for joint gaps as defined in claim 2, WHEREIN an inclined plane is arranged on the side of the building.

7. A bridging means for joint gaps as defined in claim 6, WHEREIN an inclined plane adapted to said inclined plane of said building component is located on said safety box so that said two planes in cooperation form said ramp.

8. A bridging means for joint gaps as defined in claim 6, WHEREIN said inclined plane on the side of the building is built as anchoring disk coated with steel.

9. A bridging means for joint gaps as defined in claim 8, WHEREIN said anchoring disk is anchored in the building by means of an anchoring stirrup piece and, if necessary, further anchoring members.

10. A bridging means for joint gaps as defined in claim 1 or 2, WHEREIN said expansion joint construction comprises the following:

a) metallic marginal profiles anchored in the respective building components, b) central profiles extending in parallel to said marginal profiles, wherein c) said central profiles are arranged on at least one tie-bar bridging the joint gap, and d) expansion strips made from an elastic resilient material, which bridge the gap between said marginal and/or central profiles.

11. A bridging means for joint gaps as defined in claim 10, WHEREIN said tie-bars engage with correspondingly formed shafts of said safety boxes.

12. A bridging means for joint gaps as defined in claim 9, WHEREIN anchoring of said expansion joint construction in the building components is carried out in concrete polymer.

13. A bridging means for joint gaps as defined in claim 3, WHEREIN anchoring of said safety means in the building component is carried out in concrete polymer.

14. A bridging means for joint gaps as defined in claim 8, WHEREIN anchoring of said anchoring disk in the building components is carried out in concrete polymer.

* * * * *